United States Patent [19]

Nakata

[11] Patent Number: 4,878,161

[45] Date of Patent: Oct. 31, 1989

[54] PROJECTOR-TYPE HEAD LAMP ASSEMBLY FOR VEHICLES

[75] Inventor: Yutaka Nakata, Isehara, Japan

[73] Assignee: Ichikoh Industries, Ltd., Tokyo, Japan

[21] Appl. No.: 326,076

[22] Filed: Mar. 20, 1989

[30] Foreign Application Priority Data

Mar. 22, 1988 [JP] Japan ..... 63-65638
Mar. 15, 1989 [JP] Japan ..... 1-60790

[51] Int. Cl.[4] ..... F21V 7/00

[52] U.S. Cl. ..... 362/305; 362/297; 313/111; 313/113; 313/117

[58] Field of Search ..... 313/111, 113, 117; 362/297, 304, 305, 61

[56] References Cited

U.S. PATENT DOCUMENTS 4,727,458 2/1988 Droste et al. ..... 362/61
4,772,987 9/1988 Kretschmer et al. ..... 362/61
4,800,467 1/1989 Lindae et al. ..... 362/61

*Primary Examiner*—Carroll B. Dority
*Attorney, Agent, or Firm*—Foley & Lardner, Schwartz, Jeffery, Schwaab, Mack, Blumenthal & Evans

[57] ABSTRACT

The projector-type head lamp assembly comprises a reflector having plural reflection surfaces different in reflection characteristics from each other. The reflector has disposed in the center of the reflection surface thereof a first reflection surface area extended horizontally; adjoiningly at the top and bottom, respectively, of the first reflection surface area a second reflection surface area extended horizontally; and adjoiningly to the second reflection surface areas a third reflection surface area extended horizontally. The reflection surface areas are composed of numerous fine surface elements smoothly continuous to each other. The orientations of the fine surface elements belonging to the first to third reflection surface area are so determined that the incident light rays from a light source are converged to near the center of the edge of the shade; into a horizontal zone including up to a position spaced a predetermined distance along the meridional image plane of the convex lens from the center of the edge of the shade; and into a vertical zone including up to a position extended downward from the center of the edge of the shade, respectively. Thereby, the luminous intensity distribution pattern projected in front of a car provides a sufficient horizontal divergence and intensity of light beam while keeping the high luminous intensity at the center, so that the relatively near range in front of the car is provided with a sufficiently wide horizontal illumination.

8 Claims, 11 Drawing Sheets

PROJECTOR-TYPE HEAD LAMP ASSEMBLY FOR VEHICLES

BACKGROUND (a) Field of the Invention

The present invention relates to a projector-type head lamp assembly for use with vehicles.

(b) Description of the Prior Art

The essential requirements for the head lamp for a vehicle or car are to provide a bright view in front of the car and to provide a luminous intensity distribution pattern owing to which the driver of a car running in the opposite direction is not dazzled by the coming light beam.

As a head lamp which has a luminous intensity distribution pattern meeting these requirements, of which the lens configuration is simple and which can project light rays to a relatively far range in front of the car, the so-called projector-type head lamps have been proposed. Such a projector-type head lamp comprises a reflector of which the reflection surface is composed of a spheroidal surface or a paraboloidal surface, or a combination of them, a shade disposed in front of the reflector and which blocks a part of the light rays reflected by the reflector to define a light-dark boundary, and an image forming optical system disposed in front of the shade. In such projector-type head lamp, the reflection surface is generally formed by a spheroidal surface or a paraboloidal surface, or a combination of them and a major consideration is given to provide an ample illumination over a long distance in front of the car.

However, in a relatively near range in front of the car, the light beam does not spread so widely horizontally that it is sometimes difficult for the driver to visually check a person walking on the sidewalk within the range or a car approaching an intersection also within range. Namely, the conventional head lamps involves a problem not preferable for the traffic safety.

Also, in case of a projector-type head lamp in which the lamp bulb filament is disposed in the direction of the optical axis, the luminous intensity on the road surface in the relatively near range in front of the car is high while the luminous intensity in the far range is extremely low as compared with that in the near range, so that an object in the far range cannot be easily viewed.

SUMMARY OF THE INVENTION

The present invention has an object to overcome the above-mentioned drawbacks of the prior-art projector-type head lamps by providing an improved projector-type head lamp.

The present invention has another object to provide a projector-type head lamp which can provide a wide illumination horizontally without sacrifice of the luminous intensity in the center of the luminous intensity distribution pattern and a visibility of the far range in front of the car while keeping low the luminous intensity on the road surface in the relatively near range before the car.

The above objects of the present invention are attained by providing a projector-type head lamp comprising, according to the present invention, a reflector having an inner reflection surface, a lamp bulb having at least one axial coil filament disposed on the axis of the reflector, a convex lens disposed in front of the reflector, and a shade disposed between the reflector and convex lens and which has provided near the focus of the convex lens an optically effective edge which provides a light-dark boundary by blocking a part of the light rays projected from the lamp bulb and reflected by the inner reflection surface, wherein (a) the coil axis is arranged parallelly to the optical axis of the reflector and the reflection surface is composed of a plurality of reflection surface areas of different reflection properties;

(b) the reflection surface area includes a first reflection area extended horizontally from the center including the apex of the inner reflection surface, a second reflection surface area having at least two surface areas adjoining the first surface area at the top and bottom, respectively, of the first surface area and which are extended horizontally, and a third reflection surface area having at least two reflection areas adjoining the second reflection surface areas, respectively;

(c) the first to the third surface areas are formed from numerous fine surface elements contiguous smoothly to each other, the fine surface elements belonging to each of the surface areas being so oriented in different orientations, respectively, as predetermined that the incident light rays from the lamp bulb are converged to different points in the vicinity of the edge of the shade; and (d) the orientations of the fine surface elements belonging to the first surface area are so determined that the incident light rays from the lamp bulb are converged near the center of the top end of the edge of the shade, the orientations of the fine surface elements belonging to the second surface areas being so determined that the incident light rays from the lamp bulb are converged to a horizontal zone including up to a position spaced horizontally a predetermined distance from the center of the top end of the edge of the shade, and the orientations of the fine surface elements belonging to the third surface areas being so determined, correspondingly to the orientations of the fine surface elements belonging to the first reflection surface area, that the incident light rays from the lamp bulb are converged into a vertical zone including up to a position extended downward from near the center of the top end of the edge of the shade.

These and other objects and advantages of the present invention will be better understood from the ensuing description made, by way of example, of the embodiments of the present invention with reference to the drawings.

DETAILED DESCRIPTION OF THE PREFERRED EMBODIMENTS

Figure 1:
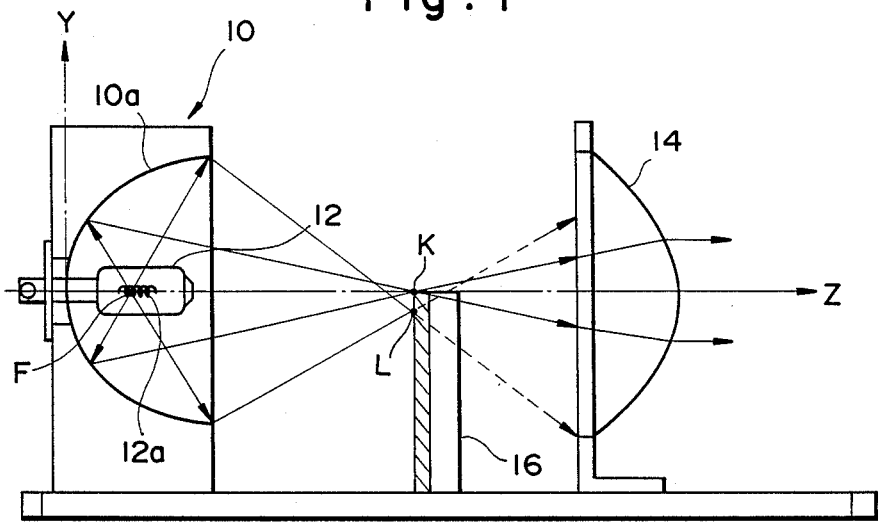
FIG. 1 is a schematic side elevation showing the optical system of the projector-type head lamp assembly according to the present invention.
Figure 2:
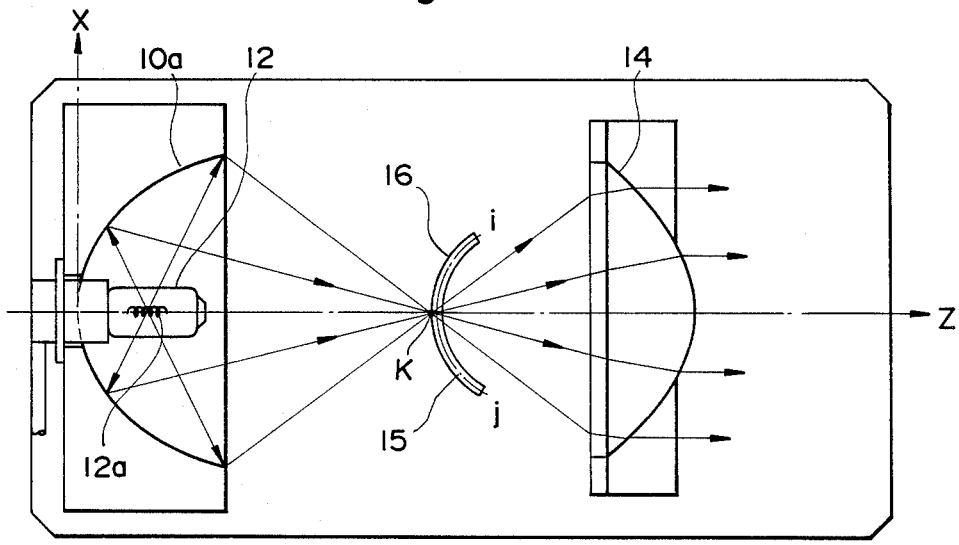
FIG. 2 is a schematic plan view showing the optical system of the projector-type head lamp assembly according to the present invention.
Figure 6:
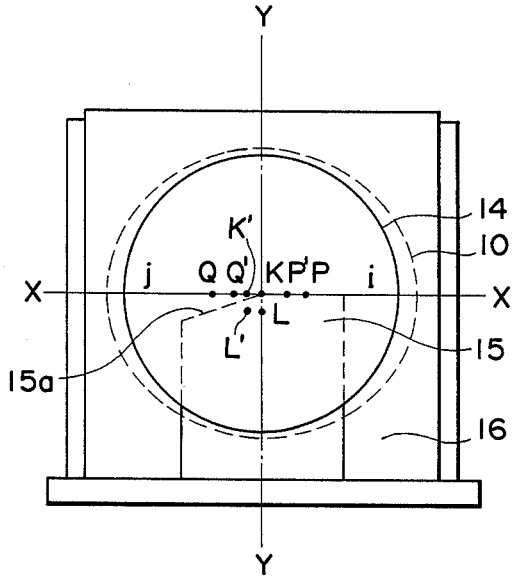
FIG. 6 is a schematic front view of the optical system shown in FIG. 1.

FIGS. 1 and 2 show schematically the optical system of the projector-type head lamp assembly according to the present invention. In Figures, the reference numeral 10 indicates a reflector of which the reflection surface 10*a* is composed of a plurality of reflection surface areas A to D which are of different reflection characteristics from each other, as will be described later. The center axis of the reflector 10 lies on the Z axis as shown, and a convex lens 14 is disposed in front of and coaxially with the reflector 10. A lamp bulb 12 has an axial coil filament 12*a* and coil axis is arranged parallelly to the optical axis (Z axis) of the reflector 10. There is disposed between the reflector 10 and convex lens 14 a shade 16 of which the upper edge 15 is disposed near the meridional image plane i-j of the convex lens 14. Actually, the meridional image plane is nearly a part of a spherical surface, the line i-j in Figures indicating the intersection between the horizontal plane (XY plane) including the optical axis and the spherical surface. The upper edge 15 has a sloping edge 15*a* which goes away downward from the meridional image plane i-j as shown in FIG. 6. Such shade 16 blocks a part of those light rays reflected by the reflection surface areas A to D of the reflector 10, which go downward of the shade, thereby providing a pattern projected frontward through the convex lens 14 with a light-dark boundary.

Figure 5:
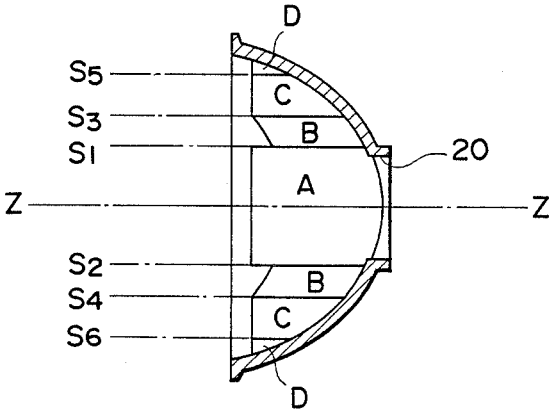
FIG. 5 is a sectional view taken alone the line V—V in FIG. 3.
Figure 4:
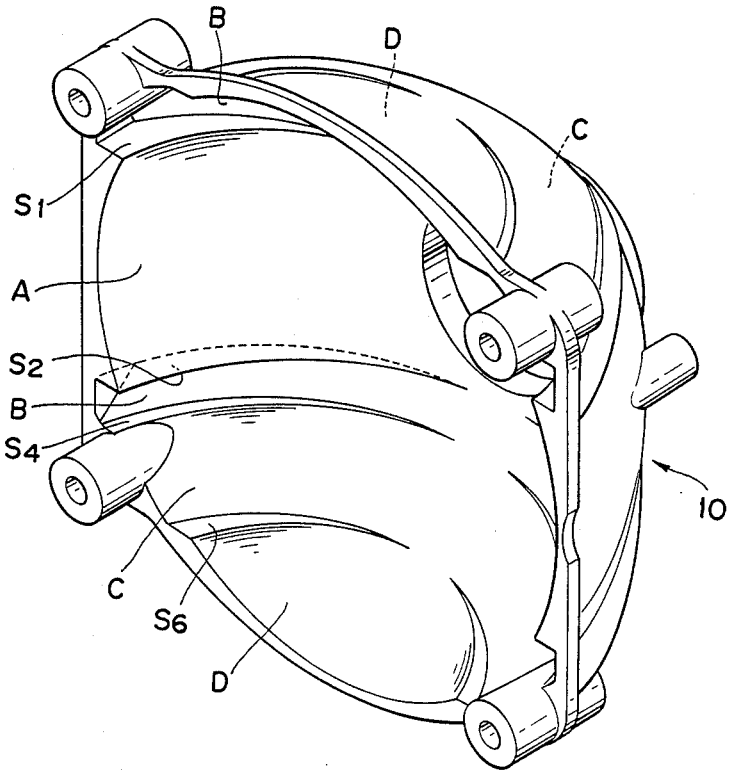
FIG. 4 is a perspective view of the reflector.

The inner reflection surface 10*a* of the reflector 10 in the projector-type head lamp assembly according to the present invention is composed of a plurality of reflection surface areas different in reflection characteristics from each other. The reflector 10 has formed near the center thereof, that is, the apex thereof, an opening 20 through which the lamp bulb 12 is mounted. The reflection surface area A is formed as a curved surface extended horizontally from the center including the opening 20. There are disposed two reflection surface areas B adjoining the reflection surface area A at the top and bottom, respectively, thereof. These reflection surface areas B are formed each as a curved surface extended horizontally. Also there are disposed two reflection surface areas C adjoining the reflection surface areas B at the top and bottom, respectively, thereof and they are formed each as a curved surface extended horizontally. Namely, the upper reflection surface area C adjoins the upper reflection surface area B at the top thereof, while the lower reflection surface area C adjoins the lower reflection surface area B at the bottom thereof. Furthermore, there are disposed two reflection surface areas D adjoining the reflection surface areas C at the top and bottom, respectively, thereof. Namely, the upper reflection surface area D adjoins the upper reflection surface area C at the top thereof, while the lower reflection surface area D adjoins the lower reflection surface area C at the bottom thereof. The reflection surface areas B, C and D are composed each of two reflection surfaces disposed opposite to each other around the opening 20. The boundaries between the reflection surface areas A and B are defined by two planes S1 and S2 parallel to a horizontal plane in which the Z—Z axis lies, while the boundaries between the reflection surface areas B and C and those between the reflection surface areas C and D are similarly defined by two planes S3 and S4, and S5 and S6, respectively, parallel to the horizontal plane in which the Z—Z axis lies. The areas near the intersection between each reflection surface area and vertical plane in which the Y—Y axis lies are contiguous to each other smoothly as shown in FIG. 5, but the areas connecting two adjacent reflection surface areas are formed as steps defined by the horizontal planes S1 to S6, respectively, in other areas than those near the intersection.

Figure 10:
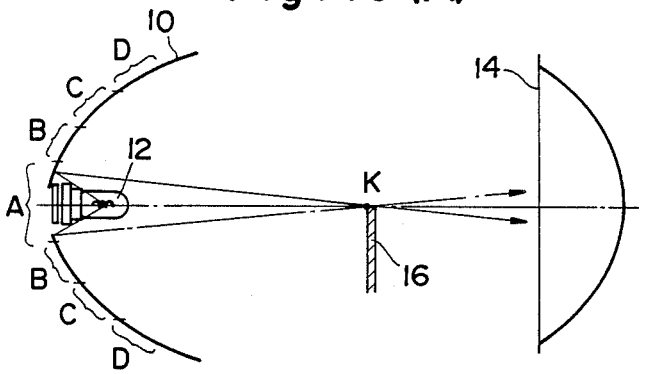
FIGS. 10 (A) to (E) are drawings for explanation of the convergence of the light rays reflected by the reflection surface areas of the reflector, showing the side elevation of the optical system.
Figure 11:
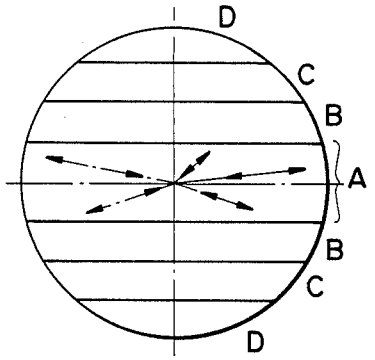
FIGS. 11 (A) to (E) are drawings for explanation of the convergence of the light rays reflected by the reflection surface areas of the reflector, showing the front view of the optical system and the drawings corresponding to FIGS. 10 (A) to (E), respectively.
Figure 10:
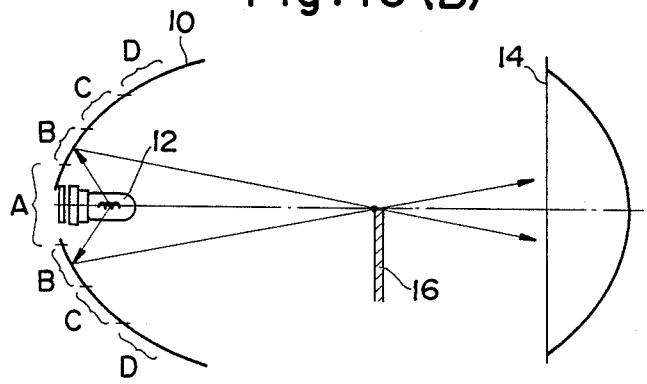
Figure 11:
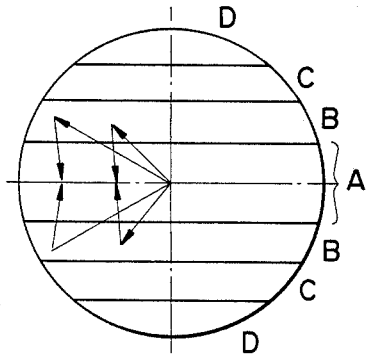
Figure 10:
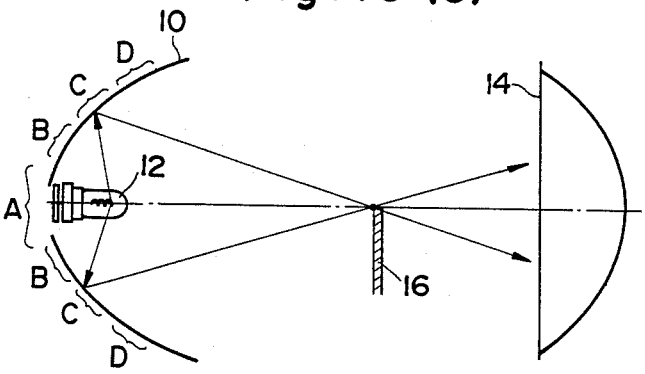
Figure 11:
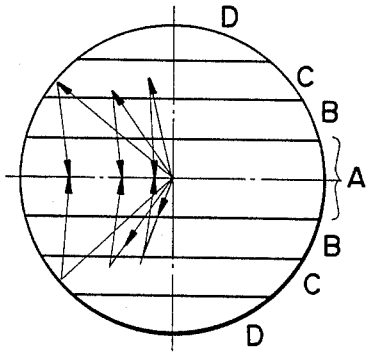
Figure 10:
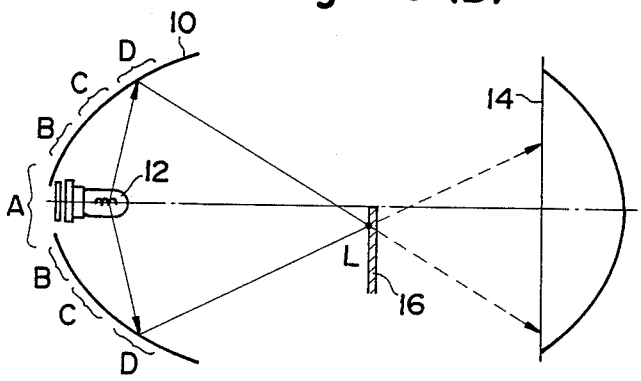
Figure 11:
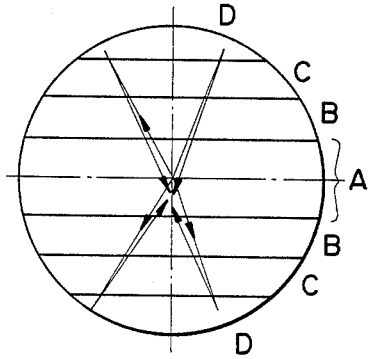
Figure 11:
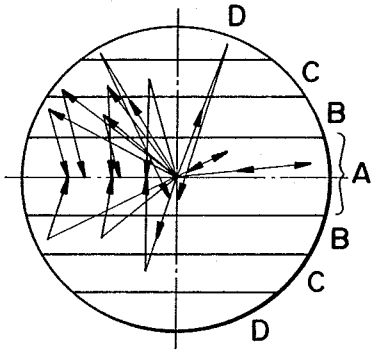
Figure 10:
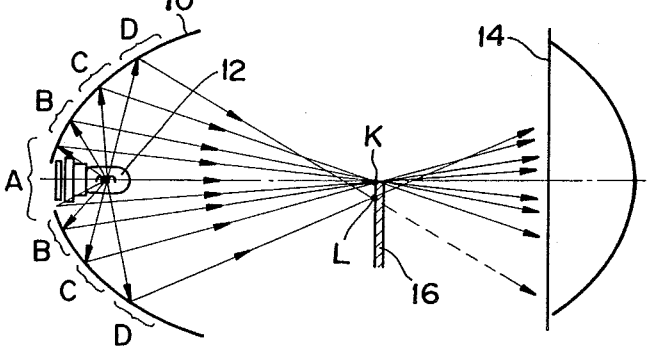

The reflection surface area A is formed as such a curve surface as converges the incident light rays from the lamp bulb 12 to near a central point K at the top end of the edge 15 of the shade 16. The reflection surface area B is formed as such a curved surface as converges the incident light rays from the lamp bulb 12 into a first horizontal zone defined by two points P and Q lying in the horizontal plane in which the center point K of the top end of the edge 15 of the shade 16 also lies and which are spaced a predetermined distance from the Z—Z axis. The reflection surface area C is formed as such a curved surface as converges the light rays from the lamp bulb 12 into a second horizontal zone defined by other two points P' and Q' lying in the horizontal plane in which the center point K at the top end of the edge 15 of the shade 16 also lies and which are spaced from the Z—Z axis a predetermined distance shorter than the above-mentioned predetermined distance. The reflection surface area D is formed as such a curved surface as converges the light rays from the lamp bulb 12 to near a point L spaced vertically downward a predetermined distance from the center point at the top end of the edge 15 of the shade 16. The points K and L to which the incident light rays from the lamp bulb 12 are reflected at the reflection surface areas and converged and the points P and Q, and P' and Q' defining the first and second horizontal planes, respectively, are shown in FIG. 6, and the converged states of the light rays reflected at the reflection surface areas A to D is shown in FIGS. 10 (A) to (D). FIG. 10 (E) shows the converged states shown in FIGS. (A) to (D) together. FIGS. (A) to (E) are schematic views of the converged states in FIGS. 10 (A) to (E), respectively, from the shade 16. In this embodiment, the distance between the points P and Q is set to about 20 mm, that distance between the points P' and Q' is to about 10 mm, and that between the points K and L is to about 3 mm.

The curved surfaces of these reflection surface areas are formed by groups of numerous fine surface elements smoothly contiguous to each other. The orientation direction of each of the fine surface elements belonging to each surface area is determined using a mathematical method. The fine surface elements are formed continuously and smoothly by an NC machine. The reflection surface areas A and D are contributed to the increase of the luminous intensity at the center of the luminous intensity pattern projected through the convex lens 14 and limits the pattern from spreading downward, while the reflection surface areas B and C are contributed to the increase of horizontal spreading of the pattern and also to the increase of luminous intensity.

Figure 7:
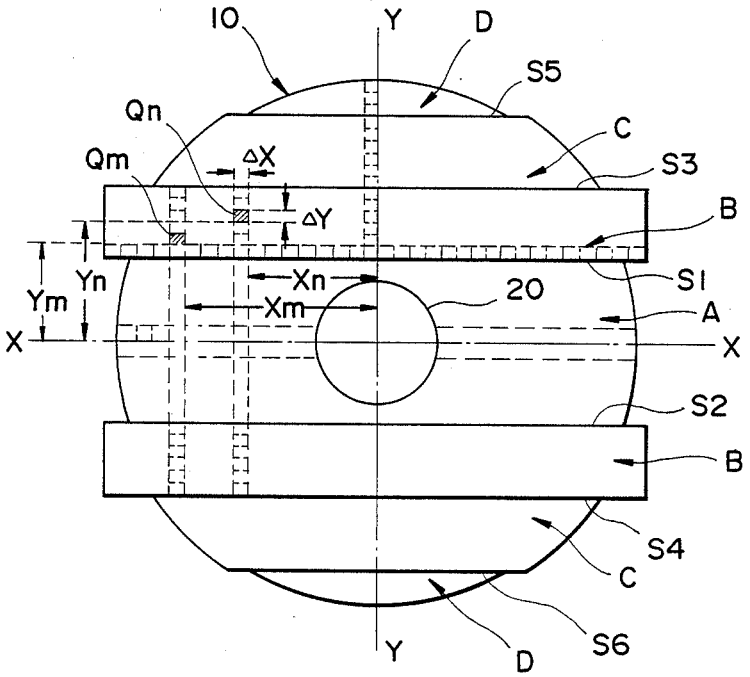
FIG. 7 is a drawing for explanation of the actions of the reflection surface areas of the reflector, the reflector being shown as enlarged in scale.
Figure 8:
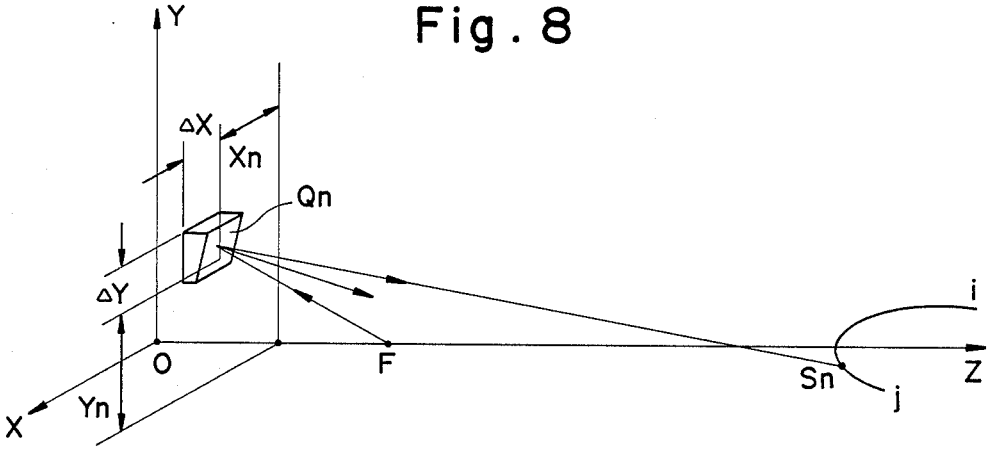
FIGS. 8 and 9 are drawings for explanation of how to determine the orientations of the fine surface elements belonging to the respective reflection surface areas of the reflector.
Figure 9:
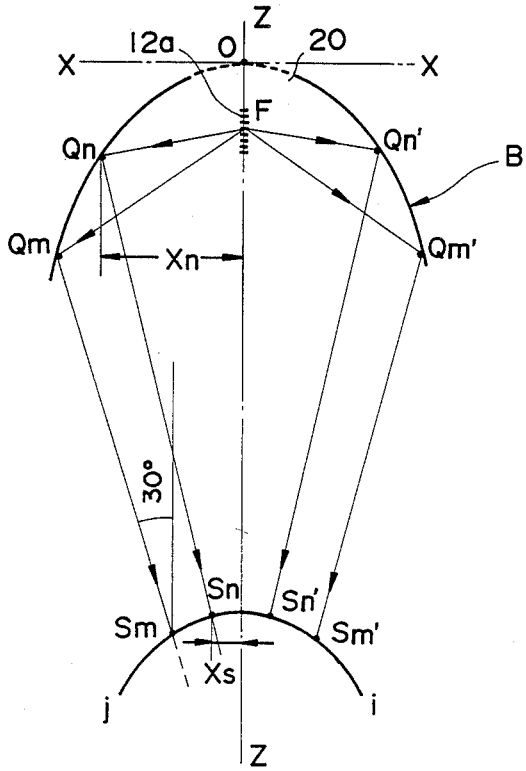

Referring now to FIGS. 7 to 9, how to select the orientation of each of the fine surface elements belonging to the reflection surface area B will be explained. The orientations of the fine surface elements belonging to the other reflection surface areas A, C and D will be similarly determined so as to have the above-mentioned reflection characteristics.

In the XYZ coordinates taking as the origin the apex O of the reflector 10, the fine surface element Qn (Xn, Yn) belonging to the reflection surface area B has an area indicated with a fine area $\Delta S$ of $\Delta X \times \Delta Y$. In this embodiment, $\Delta x = \Delta y = 0.2$ mm and $\Delta S = 0.04$ mm$^2$. A great number of such fine surface elements are connected continuously and smoothly to one another to form the reflection surface area B. As shown in FIG. 8, the orientation N of the fine surface element Qn is so determined that the light rays emitted from the center F of the filament 12*a* and reflected at the fine surface element Qn are directed toward the point Sn in the first horizontal zone. Actually, the orientation of a fine surface element having the same X coordinate as the fine surface element Qn is determined so that the light rays are directed toward the same point Sn in the first horizontal zone. The orientation direction of the fine surface element Qm in a position more distant than the fine surface element Qn from the X axis is similarly determined so that the light rays are directed toward the point Sm in the first horizontal area. The orientation of a fine surface element having the same X coordinate as the fine surface element Qm has is so determined that the light rays are directed toward the same point Sm in the first horizontal zone. In the above, the left half of the reflection surface area B adjoining the top of the reflection surface area A has been explained. In the right half of the reflection surface area B, the orientations of the fine surface elements Q'n located symmetrically to the fine surface element Qn with respect to the YZ plane and the fine surface area Q'm located symmetrically to the fine surface element Qm with respect to the YZ plane are so determined that the light rays reflected at the fine surface elements Q'n and Q'm are directed toward the points S'n and S'm, respectively, symmetrically to the points Sn and Sm, respectively, with respect to the Z axis. Therefore, there can be established between a point Xn being an X-coordinate of the fine surface element Qn in the above-mentioned reflection surface area B and a point Xs being the X-coordinate of the convergence point Sn a functional relation of $Xs = f(Xn)$, the function f being determined based on what target luminous intensity pattern is formed in front of the car.

The orientations of the fine surface elements belonging to the reflection surface area C are determined similarly to those of the fine surface elements of the reflection surface area B, provided that the second horizontal zone in which the light rays reflected at the reflection surface area C is somewhat narrower than the first horizontal zone in which the light rays reflected at the reflection surface area B. Namely, in this embodiment, the orientations of the fine surface elements are so determined that the light rays reflected at the reflection surface area B are so directed toward the first horizontal zone that they form an angle of a maximum of about 30 degrees with respect to the Z axis and that the light rays reflected at the reflection surface area C are so directed toward the second horizontal zone that they form an angle of a maximum of about 20 degrees with respect to the Z axis.

Figure 12:
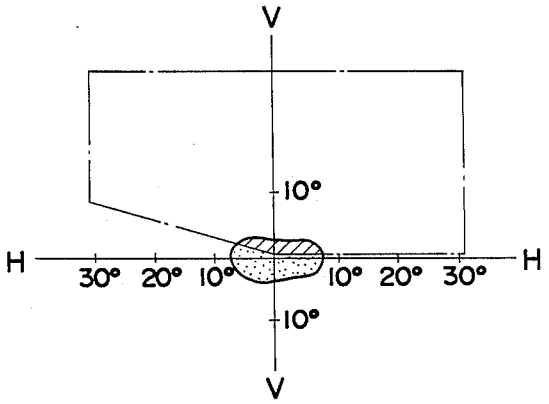
FIGS. 12 (A) to (E) are schematic views showing patterns, respectively, formed by the light rays reflected from the reflection surface areas of the reflector and which are projected through the convex lens onto the front screen, the drawings corresponding to FIGS. 10 (A) to (E), respectively.
Figure 12:
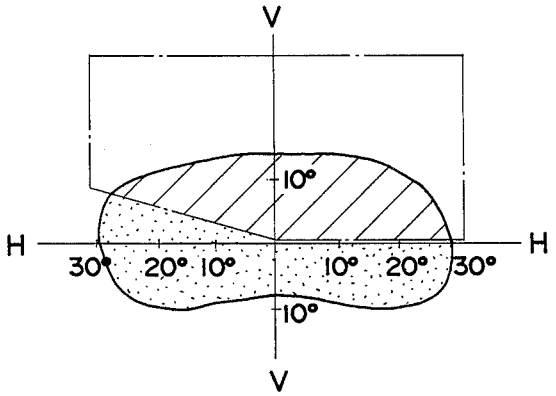
Figure 12:
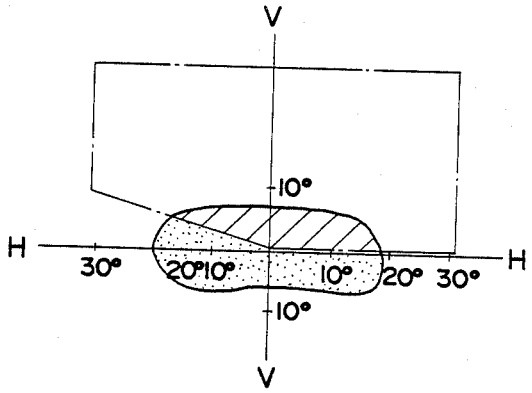
Figure 12:
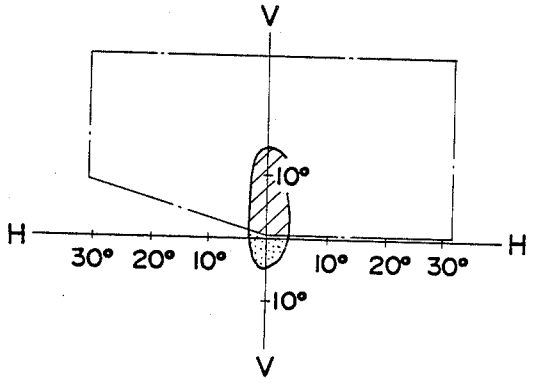
Figure 12:
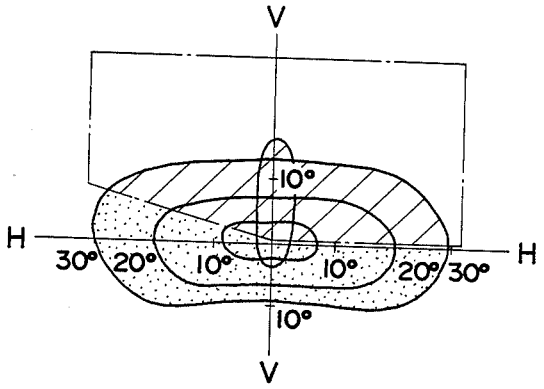

FIGS. 12 (A) to (D) show luminous intensity patterns, respectively, formed on the screen by the light rays reflected at the reflection surface areas A to D, respectively, and FIG. 12 (E) shows a luminous intensity pattern resulted from the synthesis of the patterns in FIGS. 12 (A) to (D). The hatched portions in these Figures indicate the portions cut off by the shade 16 and the portions indicated with many dots indicate the illuminated zones.

The light rays reflected at the reflection surface area A are projected as partially cut off, refracted through the convex lens 14 and projected frontward of the convex lens 14. In the pattern shown in FIG. 12 (A), an image 16' of the shade 16 appears above the light-dark boundary defined by the edge 15 of the shade 16 and a very bright illuminated zone appears below the light-dark boundary with a horizontal divergence of 7 to 8 degrees and with a downward divergence of about 4 degrees.

Similarly, the light rays reflected at the reflection surface areas B disposed at the top and bottom, respectively, of the reflection surface area A form strip-shaped illuminated zones with a horizontal divergence of about 30 degrees and with a downward divergence of about 8 degrees, respectively, as shown in FIG. 12 (B), and the light ray reflected at the reflection surface areas C disposed at the top and bottom, respectively, of the reflection surface areas B form strip-shaped illuminated zones with a horizontal divergence of about 20 degrees and with a downward divergence of about 7 degrees, respectively.

Further, the light rays reflected at the reflection surface area D located at the top and bottom, respectively, of the reflection surface areas C form bright illuminated zones with a horizontal divergence of about 3 degrees and with a downward convergence of 5 to 6 degrees.

The pattern resulted, by superposing, from the patterns formed by the reflected light rays reflected from the reflection surface areas A to D is shown in FIG. 12 (E). As seen from such superposed pattern, since the light rays reflected at the reflection surface areas B are projected with a horizontal divergence of about 30 degrees while the light rays reflected at the reflection surface areas C are projected with a horizontal divergence of about 20 degrees, the light rays reflected at the reflection surface area A are projected horizontally with an ample luminous intensity and divergence without their luminous intensity being extremely lower as they go from the bright illuminated zone to a horizontal divergent zone. Therefore, the light beam can be horizontally diverged sufficiently widely in a relatively near range in front of the car at no sacrifice of the luminous intensity at the center. Since the light rays reflected at the reflection surface areas B and C are projected with a downward divergence of about 10 degrees and the light rays reflected at the reflection surface areas D are projected with a downward divergence of 5 to 6 degrees, the downward divergence of the light rays can be minimized. Hence, since the luminous intensity in the central zone in front of the car owing to the bright illuminated zone formed at the center by the light rays reflected at the reflection surface area A and the illuminated zones formed at the center by the light rays reflected at the reflection surface areas B, C and D, respectively, the intensity of the illumination on the road in a range relatively far from the car can be made high while keeping the intensity of the illumination on the road in a relatively near range, whereby an object in the far range can be viewed more easily.

Figure 3:
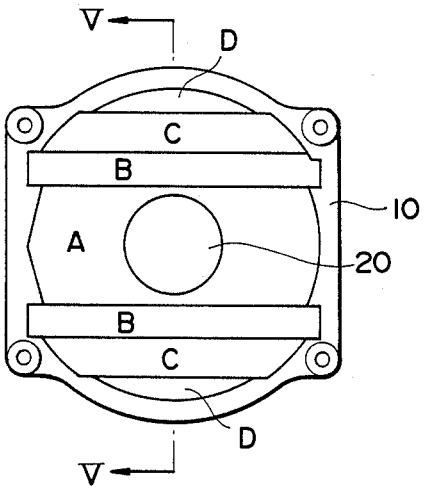
FIG. 3 is a front view of the reflector.
Figure 13:
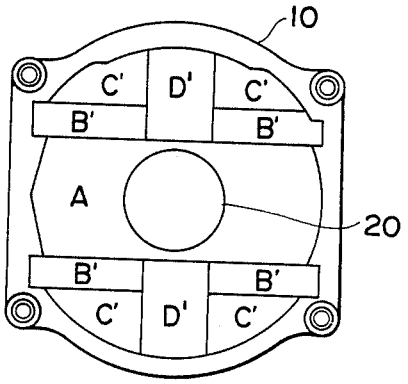
FIG. 13 is a front view showing a variant of the reflector used in the projector-type head lamp according to the present invention.

FIG. 13 shows a variant of the reflection used in the projector-type head lamp assembly according to the present invention. This reflector is different from the embodiment shown in FIG. 3 in the position and area of the reflection surface area D' which serves to converge the incident light rays from the lamp bulb 12 to near the point L spaced a predetermined distance downward from the center at the top end of the edge 15 of the shade 16. The reflection surface area D' is composed of two elongated curved surfaces disposed right above and below the opening 20 and adjoining the reflection surface area A, respectively. The reflection surface areas B' and C' corresponding to the reflection surface areas B and C are disposed adjoiningly to both lateral sides, respectively, of the reflection surface area D' . The location of these reflection surface areas permits, like the location of the reflection surface areas shown in FIG. 3, to provide a high intensity of the illumination at the center of the luminous intensity pattern and an ample horizontal divergence of the light beam.

In the embodiments having been described in the foregoing, the orientation of each of the fine surface elements belonging to the reflection surface areas A and D is so determined that the incident light rays from the center F of the filament 12*a* upon each fine surface element are converged to the point K at the center at the top end of the edge 15 of the shade 16 and the point L spaced a predetermined distance downward from the center at the top edge 15 of the shade 16, respectively. However, since the filament 12*a* is not any point light source but provides an elongated light source of a limited size disposed along the Z axis, the incident light rays from the lamp bulb 12 upon the reflection surface areas A and D are substantially converged to near the points K and L. It has been previously described that the orientation of each of the fine surface elements belonging to the reflection surface areas D is to be determined correspondingly to the orientation of each of the fine surface elements belonging to the reflection surface area A. However, the orientation should preferably be so determined that the incident light rays from the center F of the filament 12*a* of the lamp bulb 12 upon each of the fine surface elements are converged to a point K' somehow displaced from the center point K at the top end of the edge 15 of the shade 16 toward the edge 15*a*, and the orientation of each of the fine surface elements belonging to the reflection surface area D should preferably be so determined that the light rays are converged to a point L' somewhat displaced from the point L correspondingly (these points are shown in FIG. 6). Namely, the large illuminated zone at the center is shifted a little for the driver of a car running in the opposite direction not to be dazzled. As seen from the comparison with the luminous intensity distribution pattern formed by light rays converged to the points K and L as shown in FIG. 12 (E), the luminous intensity distribution pattern formed by the light rays converged to the points K' and L' is displaced about 2 degrees to the left, respectively. Therefore, the orientation of each of the fine surface elements belonging to the reflection surface areas B and C should preferably be so determined that the light rays reflected at the reflection surface areas B and C are shifted somehow to the left corresponding to the shift of the luminous intensity distribution pattern formed by the light rays reflected at the reflection surface area A. The shift of the large illuminated zone at the center is limited to a maximum of 1.5 degrees in SAE and 2.0 degrees in JIS, and so the orientation of each reflection surface area should be determined within this range.

Also, the reflection surface area A may be formed, by fitting, from a part of a spheroid taking as foci the center F of the filament 12*a* and the center point K at the top end of the edge 15 of the shade 16, and the reflection surface area D may be formed, by fitting, from a part of a spheroid taking as foci the center F of the filament 12*a* and a point L spaced a predetermined distance downward from the center point K at the top end of the edge 15 of the shade 16.

What is claimed is:

1. A projector-type head lamp assembly for use with vehicles, comprising a reflector having an inner reflection surface disposed about an optical axis, a lamp bulb having at least one axial coil filament disposed on the axis of the reflector, a convex lens disposed in front of the reflector, and a shade disposed between the reflector and convex lens and which has provided near the focus of the convex lens an optically effective edge which provides a light-dark boundary by blocking a part of the light rays projected from the lamp bulb and reflected by the inner reflection surface, wherein (a) said coil axis is arranged parallelly to said optical axis of said reflector and said reflection surface is composed of a plurality of reflection surface areas of different reflection properties;

(b) said reflection surface area includes a first reflection area extended horizontally from the optical axis including the apex of said inner reflection surface, a second reflection surface area having at least two surface areas adjoining said first surface area at the top and bottom, respectively, of said first surface area and which are extended horizontally, and a third reflection surface area having at least two reflection areas adjoining said second reflection surface areas, respectively;

(c) said first to the third surface areas are formed from numerous fine surface elements contiguous smoothly to each other, said fine surface elements belonging to each of said surface areas being so oriented in different orientations, respectively, as predetermined that the incident light rays from said lamp bulb are converged to different points in the vicinity of the edge of said shade; and (d) the orientations of said fine surface elements belonging to said first surface area are so determined that the incident light rays from said lamp bulb are converged near the center of the top end of the edge of said shade, the orientations of said fine surface elements belonging to said second surface areas being so determined that the incident light rays from said lamp bulb are converged to a horizontal zone including up to a position spaced horizontally a predetermined distance from the center of the top end of the edge of said shade, and the orientations of said fine surface elements belonging to said third surface areas being so determined, correspondingly to the orientations of said fine surface elements belonging to said first reflection surface area, that the incident light rays from said lamp bulb are converged into a vertical zone including up to a position extended downward from near the center of the top end of the edge of said shade.

2. The projector-type head lamp assembly according to claim 1, wherein said second reflection surface area is composed of at least two reflection surfaces in which the orientations of fine surface elements are so determined that the incident light rays from said lamp bulb are converged into a first horizontal zone in a range up to the position of a horizontal plane spaced a predetermined distance from the center at the top end of the edge of said shade and in which said optical axis also lies and at least two other reflection surfaces in which the orientations of fine surface elements are so determined that the incident light rays from said lamp bulb are converged into a second horizontal zone in a range up to the position of a horizontal plane spaced a distance shorter than the predetermined distance from the center at the top end of the edge of said shade and in which said optical axis also lies.

3. The projector-type head lamp assembly according to claim 1 wherein the orientation of each of the fine surface elements belonging to said second reflection surface area is so determined that the incident light rays from said lamp bulb are converged to a position of which the distance from the center at the top end of the edge of said shade increases gradually correspondingly to the distance from each of said fine surface elements to the vertical plane in which said optical axis also lies.

4. The projector-type head lamp assembly according to claim 3, wherein the orientation of each of the fine surface elements belonging to said second reflection surface area is so determined that the incident light rays from said lamp bulb are reflected into said horizontal zone so that the angle with respect to said optical axis is in a range of a maximum of about 30 degrees.

5. The projector-type head lamp assembly according to claim 3, wherein the orientation of each of the fine surface elements belonging to said at least two reflection surfaces of said second reflection area is so determined that the incident light rays from said lamp bulb are reflected into said first horizontal zone so that the angle with respect to said optical axis is in a range of a maximum of about 30 degrees, while the orientation of each of the fine surface elements belonging to said at least two other reflection surfaces of said second reflection area is so determined that the incident light rays from said lamp bulb are reflected into said second horizontal zone so that the angle with respect to said optical axis is in a range of a maximum of about 20 degrees.

6. The projector-type head lamp assembly according to claim 3, wherein the boundaries of said first to third reflection surface areas are defined by parts of planes, respectively, parallel to a horizontal plane in which said optical axis also lies.

7. The projector-type head lamp assembly according to claim 1, wherein the orientation of each of the fine surface elements belonging to said first reflection surface area is so determined that the incident light rays from said lamp bulb are converged to a position spaced a predetermined distance from the center at the top end of the edge of said shade, while the orientation of each of the fine surface elements belonging to said third reflection surface area is so determined that the incident light rays from said lamp bulb are converged to a position spaced a predetermined distance downward from the position where the light rays are converged by said first reflection surface areas.

8. The projector-type head lamp assembly according to claim 7, wherein the orientations of the fine surface elements belonging to said second reflection surface area are converged into a horizontal zone which is shifted with respect to the positions where the light rays are converged by said first and third reflection surface areas, respectively.

* * * * *